US007456795B2

(12) United States Patent
Chiba et al.

(10) Patent No.: US 7,456,795 B2
(45) **Date of Patent: *Nov. 25, 2008**

(54) RADIO MODULE AND RADIO COMMUNICATION APPARATUS WITH THE RADIO MODULE

(75) Inventors: Norimichi Chiba, Ome (JP); Hiromichi Suzuki, Hino (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 7 days.

This patent is subject to a terminal disclaimer.

(21) Appl. No.: 11/819,634

(22) Filed: Jun. 28, 2007

(65) Prior Publication Data

US 2007/0252767 A1 Nov. 1, 2007

Related U.S. Application Data

(63) Continuation of application No. 10/171,324, filed on Jun. 13, 2002, now Pat. No. 7,253,773.

(30) Foreign Application Priority Data

Jun. 13, 2001 (JP) ..... 2001-179013
May 27, 2002 (JP) ..... 2002-152144

(51) Int. Cl.
*H01Q 1/24* (2006.01)

(52) U.S. Cl. ..... 343/702; 455/550.1

(58) Field of Classification Search ..... 373/700 MS, 373/702, 845; 455/550.1
See application file for complete search history.

(56) References Cited

U.S. PATENT DOCUMENTS 4,138,681 A 2/1979 Davidson et al.
5,539,417 A 7/1996 Terry et al.
5,754,141 A 5/1998 Thompson et al.
6,097,339 A 8/2000 Filipovic et al.
6,121,930 A 9/2000 Grangeat et al.
6,147,653 A 11/2000 Wallace et al.
6,204,825 B1 3/2001 Wilz
6,211,830 B1 * 4/2001 Monma et al. ..... 343/702
6,215,454 B1 4/2001 Tran (Continued)

FOREIGN PATENT DOCUMENTS

CN 1256525 A 6/2000

(Continued)

OTHER PUBLICATIONS

Notification of Reasons for Rejection in Patent Application No. 2002-152144, Japanese Patent Office, mailed Jan. 10, 2006.

(Continued)

*Primary Examiner*—Tan Ho
(74) *Attorney, Agent, or Firm*—Finnegan, Henderson, Farabow, Garrett & Dunner, L.L.P.

(57) ABSTRACT

A metal plate in the form of a strip, bent into a bracket shape, is provided on the surface of a circuit board opposite to the surface of the board facing a human body. The proximal end of the metal plate is connected to a ground pattern provided on the circuit board, close to an antenna power supply point, with the longitudinal direction of the plate adjusted parallel to the main polarization direction of an antenna element.

18 Claims, 11 Drawing Sheets

U.S. PATENT DOCUMENTS

| | | | | |
|---|---|---|---|---|
| 6,236,368 | B1 | 5/2001 | Johson | |
| 6,239,765 | B1 | 5/2001 | Johnson et al. | |
| 6,246,373 | B1 | 6/2001 | Aoki | |
| 6,414,641 | B1 | 7/2002 | Carlson et al. | |
| 6,452,558 | B1 | 9/2002 | Saitou et al. | |
| 6,462,710 | B1 | 10/2002 | Carson et al. | |
| 6,466,170 | B2 | 10/2002 | Zhou | |
| 6,507,318 | B2 * | 1/2003 | Ito et al. | 343/702 |
| 6,697,025 | B2 | 2/2004 | Koyanagi et al. | |
| 6,873,294 | B1 * | 3/2005 | Anderson et al. | 343/702 |
| 6,947,000 | B2 * | 9/2005 | Ito | 343/702 |
| 7,106,260 | B2 * | 9/2006 | Ryu et al. | 343/702 |
| 7,253,773 | B2 * | 8/2007 | Chiba et al. | 343/702 |
| 2001/0024959 | A1 | 9/2001 | Boyle et al. | |
| 2004/0095283 | A1 * | 5/2004 | Park et al. | 343/702 |

FOREIGN PATENT DOCUMENTS

| | | | |
|---|---|---|---|
| DE | 43 00 705 | A1 | 7/1993 |
| EP | 1152481 | | 11/2001 |
| JP | 59077724 | | 5/1984 |
| JP | 9-321529 | | 12/1997 |
| JP | 10-117108 | | 5/1998 |
| JP | 11-177327 | | 7/1999 |
| JP | 11-312998 | | 11/1999 |
| JP | 2000-040910 | | 2/2000 |
| JP | 2000-101333 | | 4/2000 |
| JP | 2000-165126 | | 6/2000 |
| JP | 2000-196487 | | 7/2000 |
| JP | 2001-274718 | | 10/2001 |
| JP | 2001-308622 | | 11/2001 |
| JP | 2002-353719 | | 12/2001 |
| JP | 2002-94311 | | 3/2002 |
| JP | 2003-513493 | A | 4/2003 |
| WO | WO 9820577 | | 5/1998 |
| WO | WO 01/31735 | A1 | 5/2001 |

OTHER PUBLICATIONS

European Search Report.

Notification of Reasons for Rejection, Japanese Patent Office Feb. 28, 2005.

* cited by examiner

Measurement frequency

When metal plate is not used
(PAG=-6.26dBd)

When metal plate is used
(PAG=-4.25dBd)

RADIO MODULE AND RADIO COMMUNICATION APPARATUS WITH THE RADIO MODULE

CROSS-REFERENCE TO RELATED APPLICATIONS

This is a continuation of application Ser. No. 10/171,324, filed Jun. 13, 2002 now U.S. Pat. No. 7,253,773, which is incorporated in its entirety by reference. This application is also based upon and claims the benefit of priority from the prior Japanese Patent Applications No. 2001-179013, filed Jun. 13, 2001; and No. 2002-152144, filed May 27, 2002, the entire contents of both of which are incorporated by reference.

BACKGROUND OF THE INVENTION

1. Field of the Invention

This invention relates to a radio module connected to an antenna device, and a radio communication apparatus equipped with the radio module, and more particularly to a radio communication apparatus used close to or in contact with a human body, such as a portable telephone, PDA (Personal Digital Assistant), cordless telephone, transceiver, etc.

2. Description of the Related Art

In general, mobile communication apparatuses, represented by portable telephones, use an antenna device including a whip antenna and a helical antenna. The antenna device is formed by attaching an element of the helical antenna to the tip of the element of the whip antenna with an insulating member interposed therebetween. When the radio communication apparatus is waiting for a call, the whip antenna is pushed in the housing of the radio communication apparatus and only the helical antenna is used. On the other hand, when the radio communication apparatus executes communications, the whip antenna is pulled out of the housing and used. Both the whip antenna and helical antenna emit vertically polarized radiation, and are designed to be omnidirectional in a horizontal plane.

However, during communication, mobile communication apparatuses such as portable telephones are used with their housing positioned close to or in contact with a body of the user, in particular, a head, of a user. In this state, the whip antenna is also positioned close to the head of the user. Accordingly, the orientations of the whip antenna in the horizontal and vertical planes are influenced by the body of the user, whereby a side lobe occurs and degrades the directivity of the antenna device.

To prevent this, Jpn. Pat. Appln. KOKAI Publication No. 2000-40910, for example, has proposed a structure in which a slim plate having an end connected to the entirely earthed surface of a circuit board is provided for reducing the current that flows on the ground pattern of the circuit board, thereby suppressing the degradation of the directivity.

However, in this structure, the L-shaped plate is located on the surface of the circuit board close to the head of a user, and has an end connected to the ground pattern at a position remote from the antenna power supply terminal on the circuit board, as is evident from FIGS. 1 to 4 of the publication. Since, in this structure, the plate is positioned close to the head of the user, it is liable to be influenced by the head. Further, since the connection position of the plate with respect to the ground pattern of the circuit board is remote from the antenna power supply terminal, the current flowing to the ground pattern of the circuit board cannot be efficiently guided to the plate. Thus, the conventional structure cannot provide a sufficiently improved effect.

BRIEF SUMMARY OF THE INVENTION

It is an object of the present invention to provide a radio module capable of more effectively reducing the current flowing to the ground pattern of a circuit board, thereby further enhancing the antenna radiation characteristic, and a radio communication apparatus equipped with the radio module.

To attain the object, according to an aspect of the invention, there is provided a radio module formed by mounting a radio circuit on a circuit board with a ground pattern, and connecting the radio circuit to an antenna via a signal line, comprising: a conductor provided on a second surface of the circuit board opposite to a first surface of the circuit board that faces a human body, the conductor bypassing part of a current flowing to the ground pattern of the circuit board when the antenna is used.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

First Embodiment

Figure 1:
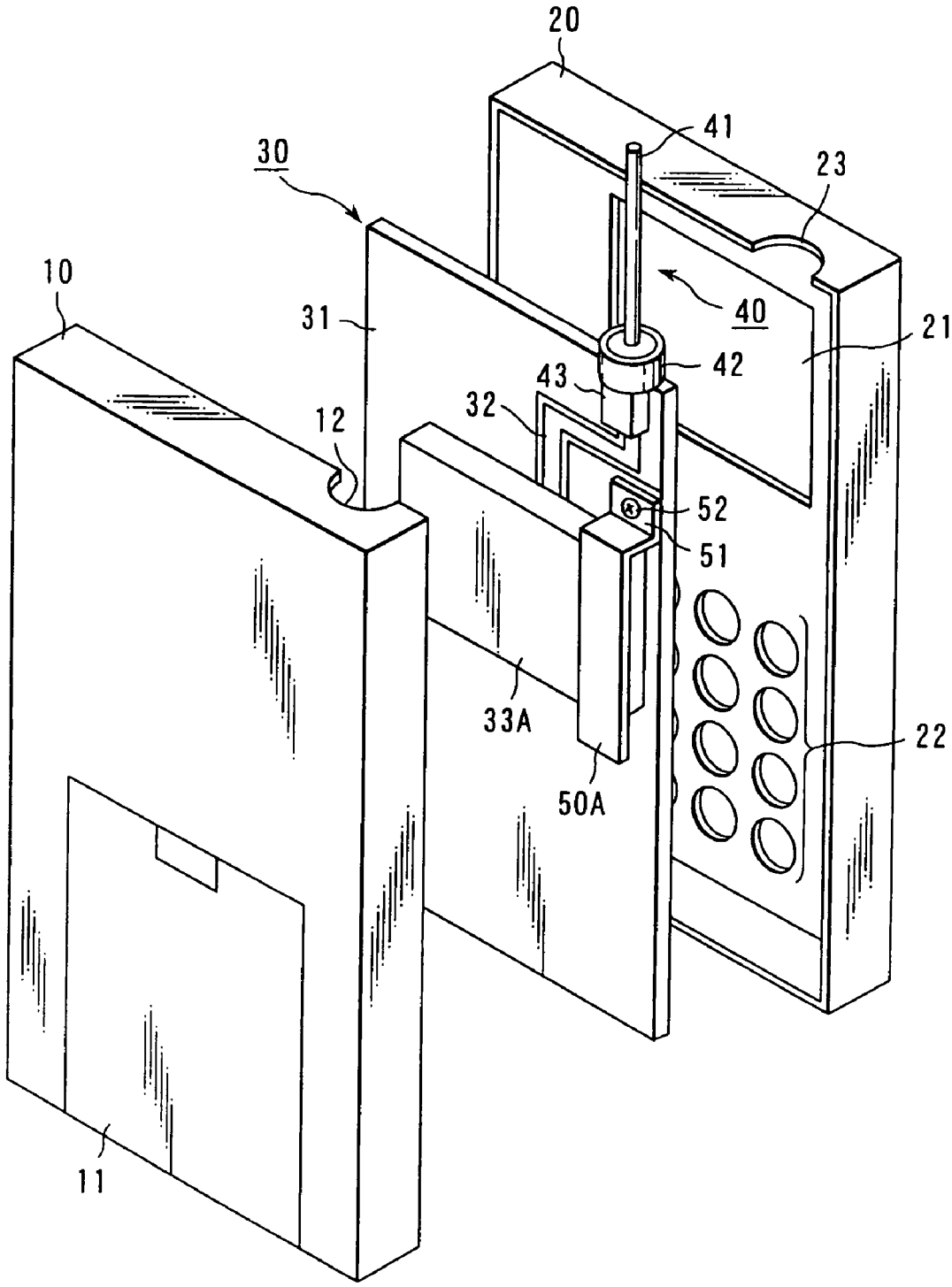
FIG. 1 is an exploded perspective view illustrating a radio communication apparatus with a radio module according to a first embodiment of the invention.

FIG. 1 is an exploded perspective view schematically illustrating the structure of a portable telephone as a radio communication apparatus with a radio module according to a first embodiment of the invention.

The portable telephone comprises a rear case 10 and front cover 20 that serve as a housing, circuit board 30 received in the rear case 10 and front cover 20, and antenna 40.

The rear case 10 has a lid 11 for enabling the mounting/dismounting of a battery therethrough. The front cover 20 has an LCD (Liquid Crystal Display)-attaching window 21, keypad-attaching window 22, sound-gathering hole (not shown) for a microphone, and a sound hole (not shown) for a speaker. During communication, the front cover 20 is positioned close to or in contact with the head of a user.

In the antenna 40, a whip antenna element 41 is held by a holder 42 such that it can execute a telescopic motion. The holder 42 is secured in antenna attachment recesses 12 and 23 formed in the rear case 10 and front cover 20, respectively. The tip of the whip antenna element 41 is coupled to the element of a helical antenna (not shown) with an insulating member interposed therebetween.

The circuit board 30 is a double-sided printed wiring board that has its top and reverse surfaces provided with respective printed wiring patterns. Specifically, a radio circuit 33A and the terminal 43 of the antenna 40 are attached to the reverse surface. The radio circuit 33A and terminal 43 are connected by a signal line pattern 32. The almost entire reverse surface of the circuit board 30, except for the area of the signal line pattern 32, is covered with a ground pattern 31. If the circuit board 30 is a multilayer board, the ground pattern is mostly formed on a second or third layer. In this case, part of the ground pattern is formed on the reverse surface of the circuit board 30. A shield cap (not shown) is mounted on the radio circuit 33A to electromagnetically isolate the interior of the radio circuit 33A from the outside.

A metal plate 50A in the form of a bracket is provided on the reverse surface of the circuit board 30. The metal plate 50A has an effective wavelength corresponding to ¼ of a radio frequency wavelength that is transmitted from and received by the antenna 40. The plate 50A has a proximal end 51 electrically and is mechanically connected to the ground pattern 31 of the circuit board 30 by a screw 52. The proximal end 51 is connected close to the antenna terminal 43, i.e., antenna power supply point. Further, the longitudinal direction of the metal plate 50A is set parallel to the longitudinal direction of the element 41 of the antenna 40, i.e., the main polarization direction. The means for connecting and fixing the metal plate 50A to the ground pattern 31 may be soldering, as well as a screw or a nut and screw.

In the above structure, during communication, part of the radio high-frequency current that flows to the ground pattern 31 of the circuit board 30 when a signal is transmitted from or received by the antenna 40 flows into the metal plate 50A. Thus, the radio high-frequency current flowing to the ground pattern 31 is reduced, thereby suppressing degradation of the radiation characteristic of the antenna 40.

Moreover, the proximal end 51 of the metal plate 50A is connected to the ground pattern 31 close to the antenna power supply point of the antenna terminal 43. In other words, the metal plate 50A is connected to the ground pattern 31 at a position at which the current distribution formed on the λ/2 wavelength whip antenna element 41 assumes a maximum value. Accordingly, the high-frequency current flowing to the ground pattern 31 of the circuit board 30 can be efficiently guided to the metal plate 50A, with the result that degradation of the radiation characteristic of the antenna 40 can be suppressed effectively.

Also, the metal plate 50A is not located on the top surface of the circuit board 30, i.e., on the front cover 20 side, but on the reverse surface of the circuit board. This reduces the influence of the head of a user upon the metal plate 50A. As a result, the radio high-frequency current can be efficiently guided from the ground pattern 31 to the metal plate 50A, thereby better suppressing the degradation of the radiation characteristic of the antenna 40.

In addition, the direction of the metal plate 50A is set parallel to the longitudinal direction of the element 41 of the antenna 40, i.e., the main polarization direction. Therefore, in the metal plate 50A, there is no danger of occurrence of a so-called cross polarization component perpendicular to the main polarization direction of the antenna 40. This means that the metal plate 50A does not raise any problem.

Figure 17:
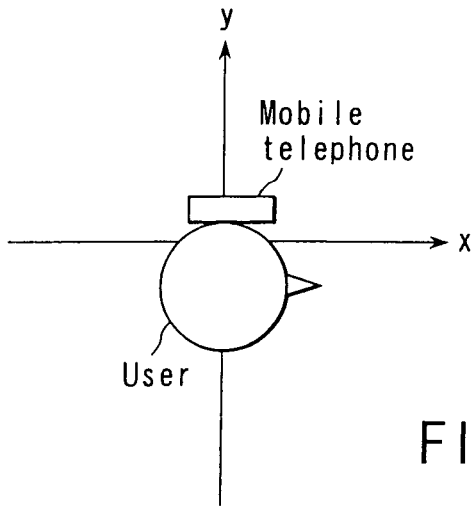
FIG. 17 is a view illustrating an example of a measurement condition concerning the antenna directivity shown in FIG. 4, FIGS. 5A and 5B.

The above-described advantage of the embodiment will now be described in more detail. Suppose that the length and width of the circuit board 30 are set to 122 mm and 36 mm, respectively, and the length and height of the metal plate 50A are set to 26 mm and 5 mm, respectively. Further, suppose that the directivity in the horizontal plane of the horizontal polarization and vertical polarization of the antenna 40 are measured using a measurement frequency of 2 GHz. At this time, suppose that the portable telephone is kept in contact with the left side of the user's head, inclined at 30 degrees to the horizontal direction, as is shown in FIG. 17.

Figure 3:
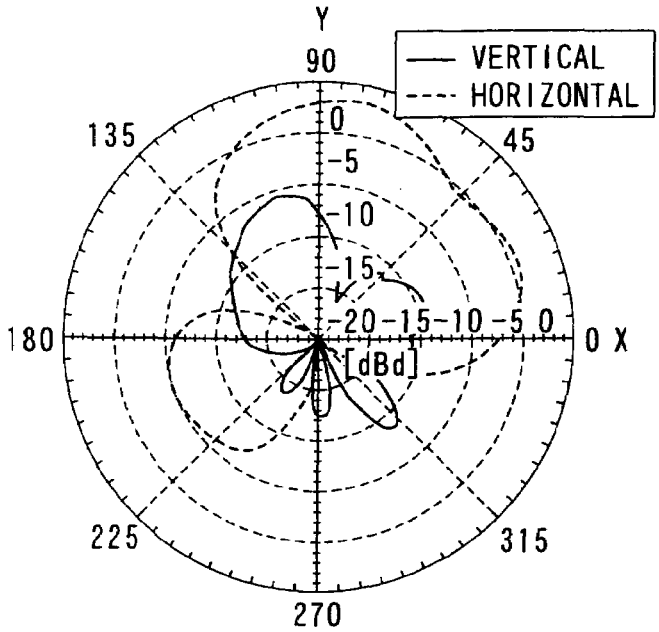
FIG. 3 is a graph illustrating measurement results concerning the antenna directivity of a conventional radio communication apparatus incorporating no metal plate.
Figure 4:
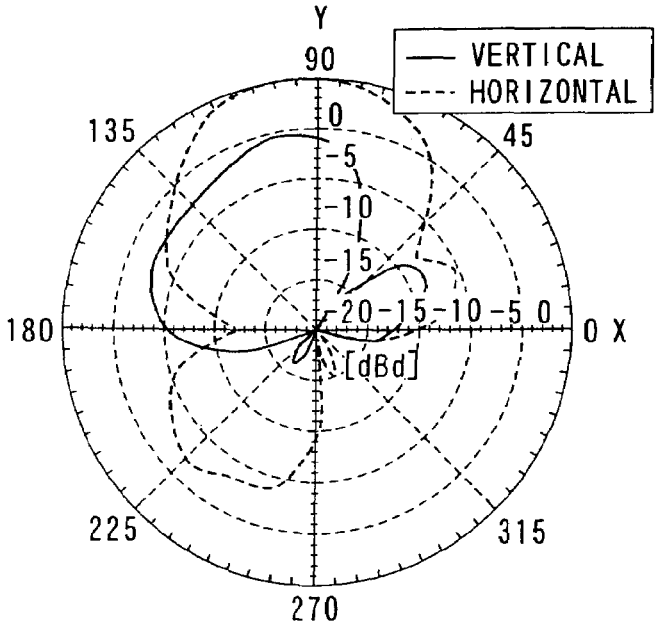
FIG. 4 is a graph illustrating measurement results concerning the antenna directivity of a radio communication apparatus incorporating a metal plate, according to the invention.

In this case, the portable telephone of the embodiment employing the metal plate 50A exhibits the directivity as shown in FIG. 4. Specifically, the pattern average gain PAG is −4.25 dBd. On the other hand, the directivity measured under the same conditions as above without using the metal plate 50A is as shown in FIG. 3, i.e., the pattern average gain PAG is −6.26 dBd. As is evident from these measurement results, in the portable telephone of the embodiment, the pattern average gain PAG, given by $$PAG = Gv + (Gh - 6\ \text{dB})$$

is improved by approx. 2 dB.

Second Embodiment

Radio modules according to a second embodiment of the invention each use a shield cap for the radio circuit to hold the metal plate.

Figure 5A:
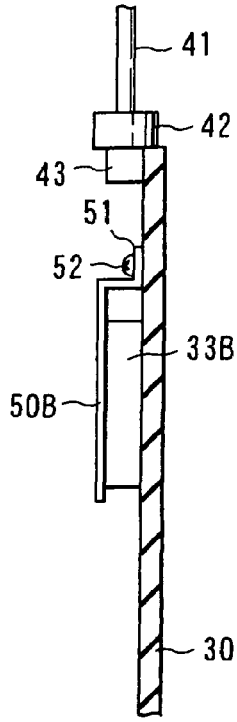
FIGS. 5A and 5B are sectional side views illustrating essential parts of different radio modules according to a second embodiment of the invention.
Figure 5B:
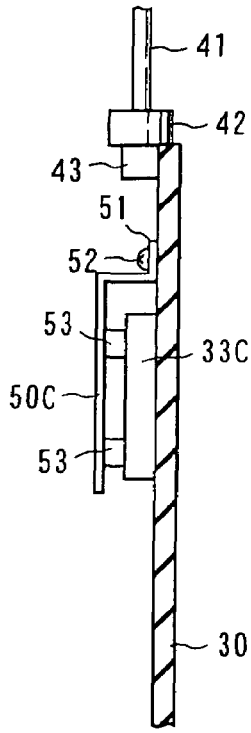

FIGS. 5A and 5B are sectional side views illustrating the respective radio modules of the second embodiment.

In the structure shown in FIG. 5A, the shield cap of a radio circuit 33B is set to substantially the same height as a metal plate 50B such that the shield cap supports the metal plate 50B. This structure enables the metal plate 50B to be mounted in a mechanically stable manner. Accordingly, the metal plate 50B is protected from the vibration or impact exerted thereon from the outside, thereby significantly improving the radiation characteristic of the antenna. This effect is especially useful for a portable radio communication apparatus or a radio communication apparatus for use in vehicles.

In the structure shown in FIG. 5B, spacers 53 are interposed between a metal plate 50C and the shield cap of a radio circuit 33C located below the plate. This structure protects the metal plate 50C from the vibration or impact exerted thereon from the outside. Also, the structure makes it unnecessary to prepare a special shield cap that has a height precisely equal to that of the metal plate 50C, and hence can be realized at low cost. Further, the distance between the ground pattern (including the shield cap) and metal plate 50C can be set large, thereby further improving the directivity.

Third Embodiment

In a radio communication apparatus with a radio module according to a third embodiment of the invention, a metal plate is beforehand secured to the inner surface of the rear case, and the proximal end of the metal plate is pressed against the portion of the ground pattern on the circuit board close to the antenna power supply point when the circuit board is housed in the rear case, thereby establishing an electrical connection therebetween.

Figure 6:
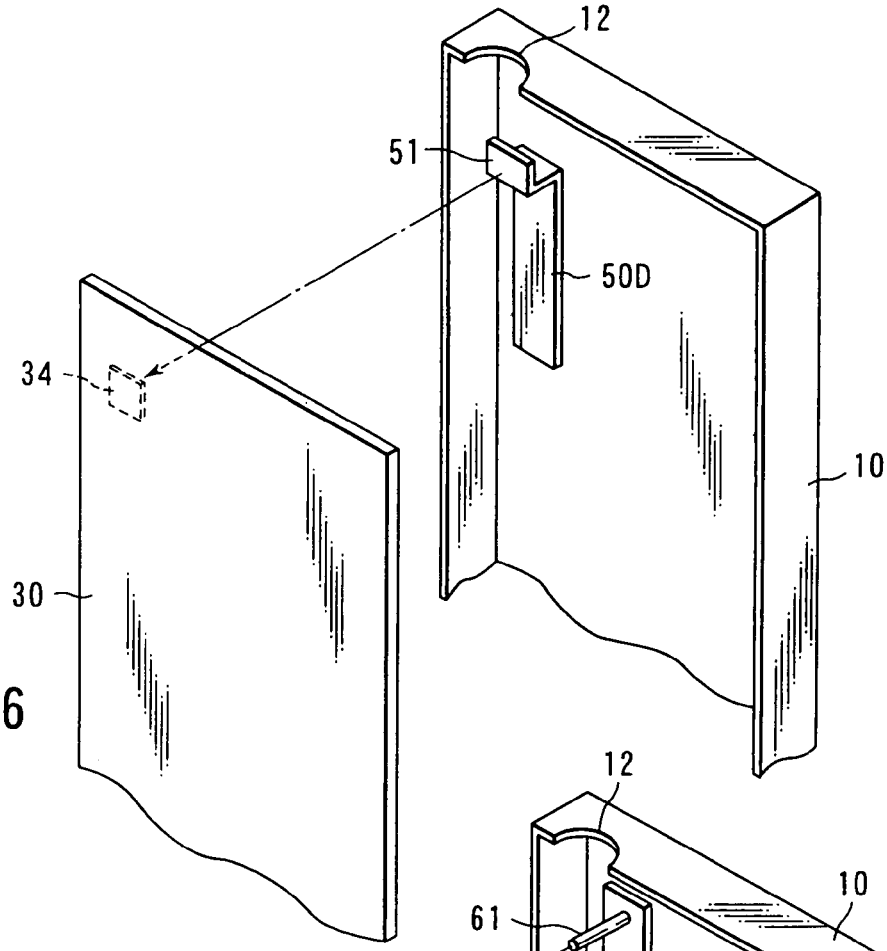
FIG. 6 is a perspective view illustrating an essential part of a radio module according to a third embodiment of the invention.

FIG. 6 is a perspective view illustrating an essential part of the radio communication apparatus of the third embodiment. A metal plate 50D in the form of a strip, bent into a bracket shape in its thickness direction, is attached to the inner wall surface of the rear case 10. As the attachment means, a method for forming an engagement claw integrally with the rear case 10, and engaging the metal plate 50D with the engagement claw may be used. Alternatively, a double-sided tape or adhesive may be used to adhere the plate to the rear case.

The metal-plate-attachment portion of the rear case 10 is set so that the proximal end 51 of the metal plate 50D opposes the portion of the ground pattern 31 of the circuit board 30 close to the antenna power supply terminal. Further, the longitudinal direction of the metal plate 50D is set parallel to the main polarization direction of the antenna 40, as in the first embodiment.

In the third embodiment, since it is not necessary to attach the metal plate 50D to the circuit board 30 using a screw or a nut and screw, the circuit board 30 is free from a problem such as the occurrence of a crack. This structure also facilitates the assemblage of the communication apparatus.

Fourth Embodiment

In a radio communication apparatus with a radio module according to a fourth embodiment of the invention, a metal plate having a connection pin at an end is secured to the inner wall surface of the rear case, and a ground pad is provided on the circuit board such that it is connected to the ground pattern on the circuit board. Where the communication apparatus is assembled, the tip of the connection pin is in electrical contact with the ground pad.

Figure 7:
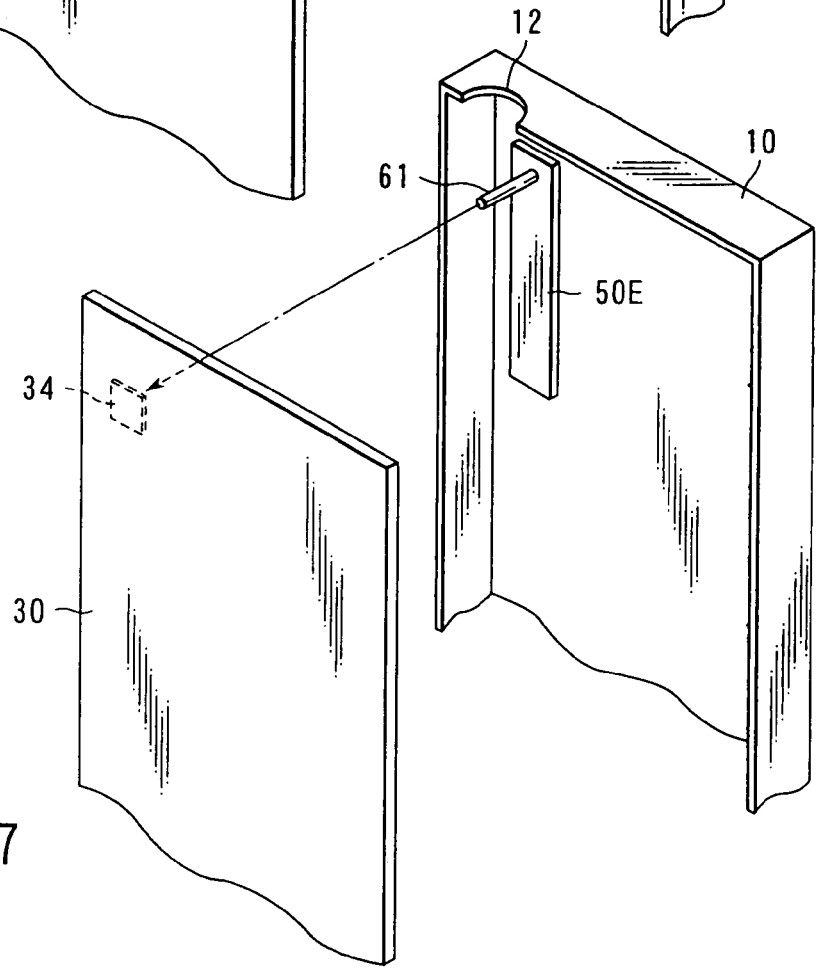
FIG. 7 is a perspective view illustrating an essential part of a radio module according to a fourth embodiment of the invention.

FIG. 7 is a perspective view illustrating an essential part of the radio communication apparatus of the fourth embodiment. A metal plate 50E in the form of a strip is attached to the inner wall surface of the rear case 10. A metal connection pin 61 is beforehand provided on an end portion of the metal plate 50E. Further, a ground pad 34 is provided on the circuit board 30 close to the antenna power supply terminal, such that it is connected to the ground pattern provided on the board 30.

The metal-plate-attachment portion of the rear case 10 is set so that the connection pin 61 is aligned with the ground pad 34 of the circuit board 30 where the communication apparatus is assembled. Further, the longitudinal direction of the metal plate 50E is set parallel to the main polarization direction of the antenna 40.

To attach the metal plate 50E to the rear case 10, attachment means similar to that of the third embodiment may be employed. That is, a method for forming an engagement claw integrally with the rear case 10, and engaging the metal plate 50E with the engagement claw may be used. Alternatively, a double-sided tape or adhesive may be used.

The fourth embodiment provides the same advantages as the third embodiment. That is, since it is not necessary to attach the metal plate 50E to the circuit board 30 using a screw or a nut and screw, the circuit board 30 is free from a problem such as the occurrence of a crack. This structure also facilitates the assemblage of the communication apparatus.

Fifth Embodiment

In a radio communication apparatus with a radio module according to a fifth embodiment of the invention, a metal plate is secured to the inner wall surface of the rear case, and a ground pad is provided on the circuit board such that it is connected to the ground pattern and has a metal ground pin projecting thereon. Where the communication apparatus is assembled, the tip of the connection pin is in electrical contact with the metal plate.

Figure 8:
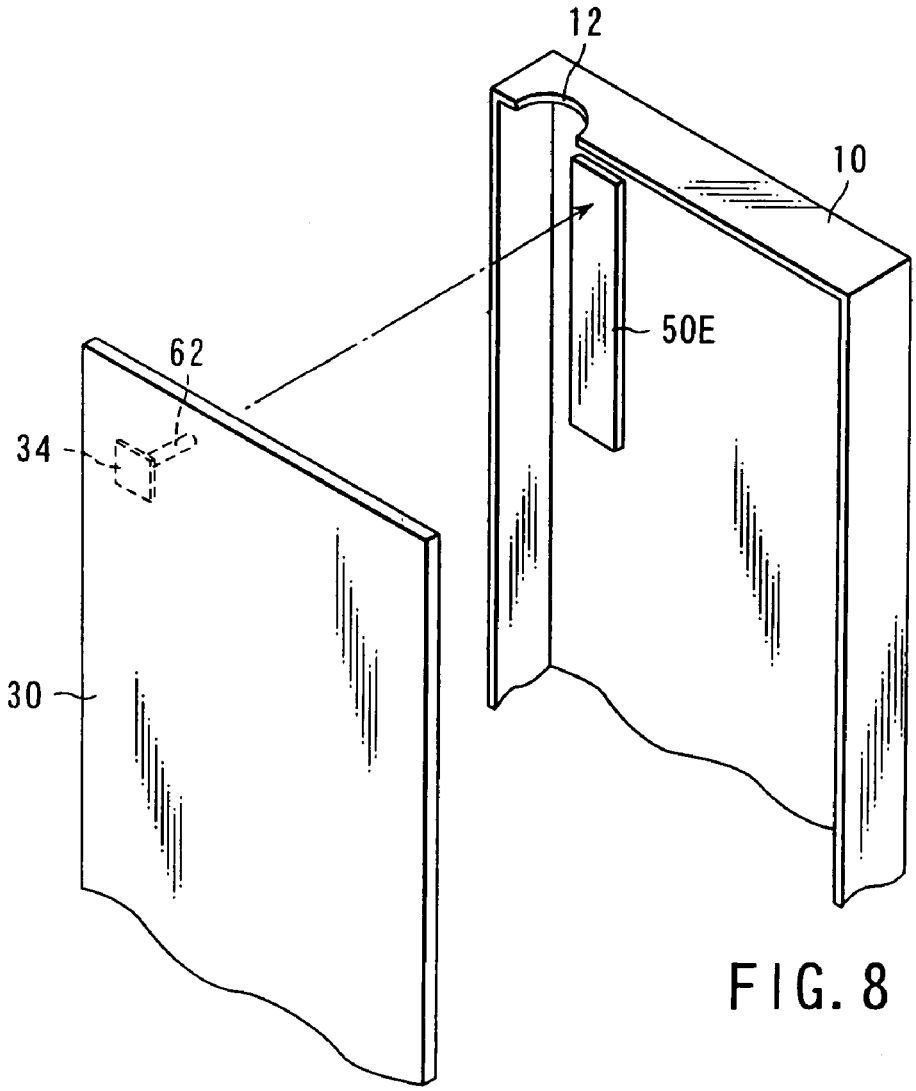
FIG. 8 is a perspective view illustrating an essential part of a radio module according to a fifth embodiment of the invention.

FIG. 8 is a perspective view illustrating an essential part of the radio communication apparatus of the fifth embodiment. A metal plate 50E in the form of a strip is attached to the inner wall surface of the rear case 10. To this end, attachment means similar to those of the third and fourth embodiments may be employed. That is, a method for forming an engagement claw integrally with the rear case 10, and engaging the metal plate 50E with the engagement claw may be used. Alternatively, a double-sided tape or adhesive may be used.

On the other hand, a ground pad 34 is provided on the circuit board 30 close to the antenna power supply terminal, and is connected to the ground pattern on the board. A metal connection pin 62 is provided on the ground pad 34. Soldering, for example, is used as the means for attaching the connection pin 62. This soldering is executed in a process in which the other circuit components are soldered to the circuit board 30.

The metal-plate-attachment portion of the rear case 10 is set so that the connection pin 62 is aligned with an end portion of the metal plate 50E where the communication apparatus is assembled. Further, the longitudinal direction of the metal plate 50E is set parallel to the main polarization direction of the antenna 40.

The fifth embodiment provides the same advantages as the fourth embodiment. That is, since it is not necessary to attach the metal plate 50E to the circuit board 30 using a screw or a nut and screw, the circuit board 30 is free from a problem such as the occurrence of a crack. Further, the connection pin 62 is mounted on the ground pad 34 of the circuit board 30. Therefore, the pin 62 can be mounted by soldering in a soldering process in which the other circuit components are soldered to the circuit board 30. This enables the communication apparatus to be produced at a lower cost than in the case where the connection pin 62 is provided on the metal plate 50E.

In the fourth and fifth embodiments, the connection pin 62 has a fixed length. However, the present invention is not limited to this. The connection pin 62 may have a structure in which an elastic mechanism using an elastic member such as a coil spring is interposed between the distal and proximal ends. This structure can absorb a dimensional difference (variation) if it exists between the ground pad 34 and metal plate 50D or 50E where the communication apparatus is assembled. As a result, the tip of the connection pin 62 can be kept in contact with the ground pad 34 or metal plate 50E with a constant pressure.

Figure 9:
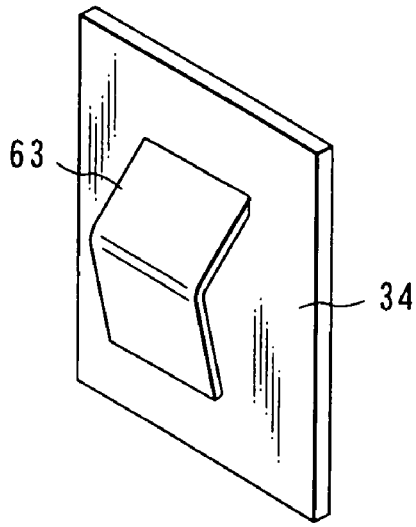
FIG. 9 is a perspective view illustrating a structure in which a contact spring is attached to a ground pad.

Instead of the connection pin 62, the structure shown in FIG. 9 may be employed, in which a contact spring 63 is provided on the ground pad 34 for electrically connecting the ground pad 34 to the metal plate 50D or 50E. The contact spring 63 may be provided on the metal plate.

Sixth Embodiment

In a radio communication apparatus with a radio module according to a sixth embodiment of the invention, a metal plate is secured to the inner wall surface of the rear case, a ground pad is provided on the circuit board such that it is connected to the ground pattern on the circuit board, and a connection pin is formed integrally with the antenna holder. Where the communication apparatus is assembled, the proximal end of the connection pin is in electrical contact with the ground pad.

Figure 10:
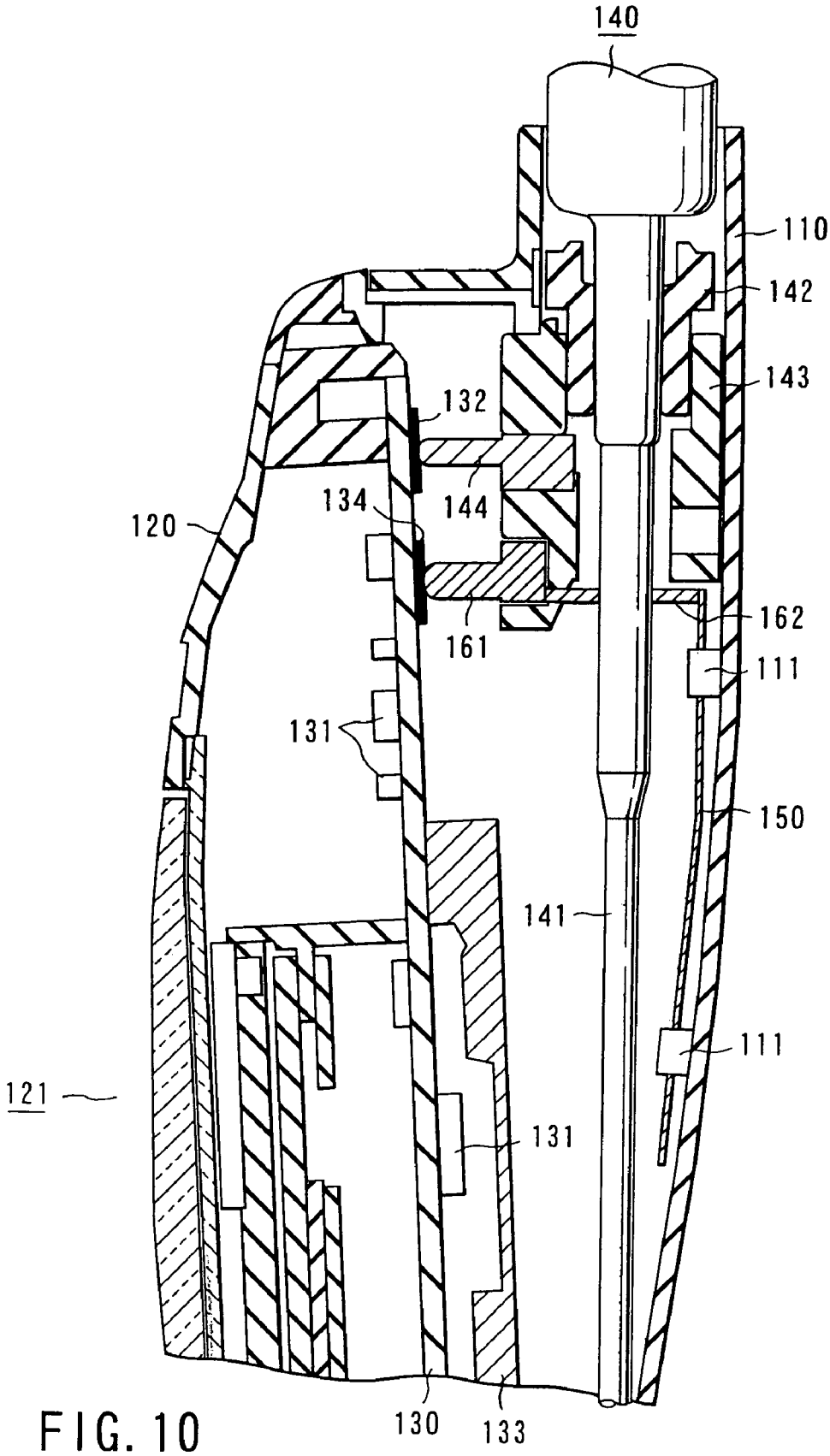
FIG. 10 is a sectional view illustrating a radio communication apparatus with a radio module according to a sixth embodiment of the invention.

FIG. 10 is a sectional view illustrating an essential part of the radio communication apparatus of the sixth embodiment. In FIG. 10, reference numeral 110 denotes a rear case, and reference numeral 120 a front cover. The rear case 110 and front cover 120 form an apparatus housing. A circuit board 130 and LCD unit 121 are housed in the housing close to the front cover 120. The circuit board 130 is mounted with a number of circuit elements 131 including a radio circuit, and the radio circuit is covered with a shield cap 133.

An antenna 140 is housed in the housing close to the rear case 110. The antenna 40 is supported by first and second holders 142 and 143, so that during communication, the element 141 of the antenna 140 can be extended to the outside of the apparatus housing through its upper opening, while when the communication apparatus is waiting for a call, the antenna element 141 can be retracted within the housing.

Figure 2:
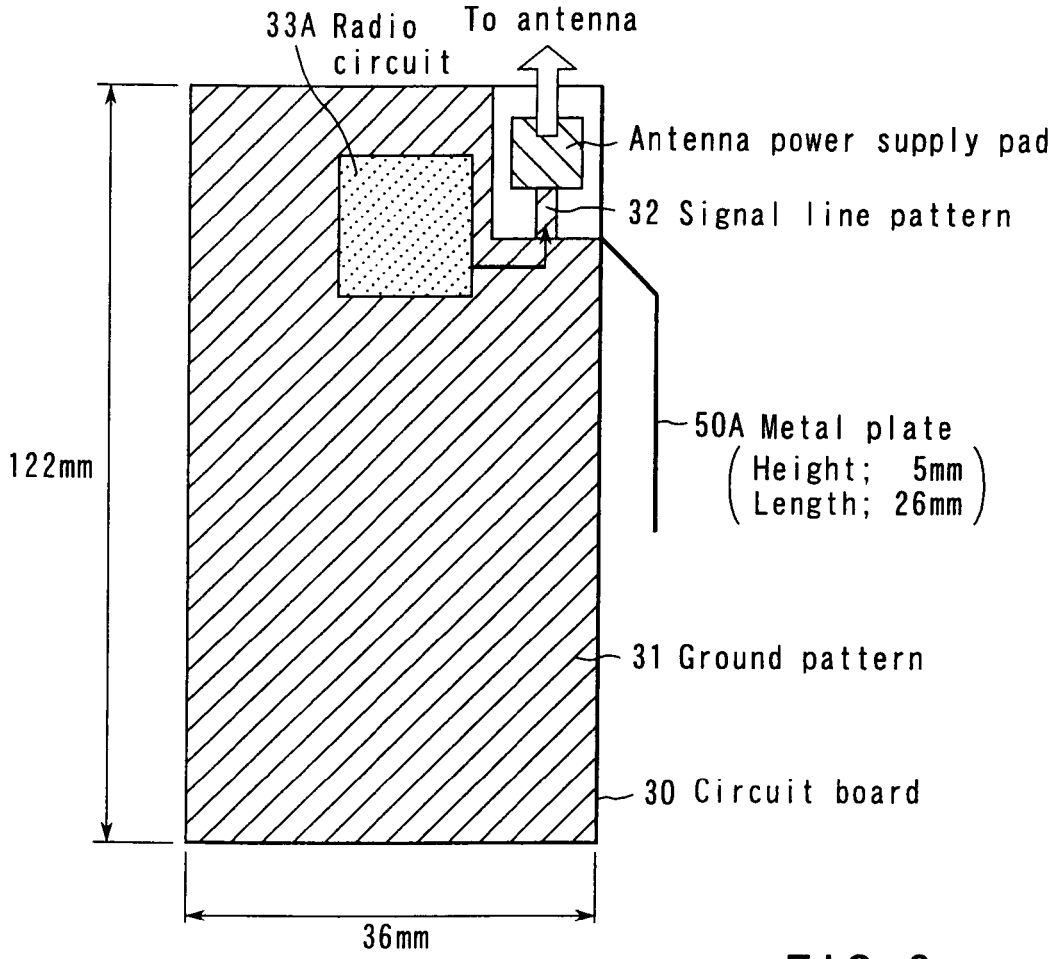
FIG. 2 is a view illustrating the specific dimensions of the radio module appearing in FIG. 1.

An antenna power supply pad 132 and ground pad 134 are provided on the surface of the circuit board 130 close to the rear case 110. The antenna power supply pad 132 is connected to the aforementioned radio circuit via, for example, a signal line pattern, as is shown in FIG. 2. The ground pad 134 is connected to a ground pattern formed on the circuit board 130.

On the other hand, a plurality of engagement claws 111 are provided on the inner wall surface of the rear case 110. The engagement claws 111 are engaged with a metal plate 150. The metal plate 150 is in the form of, for example, a strip, as shown in FIG. 8. The length of the metal plate is set to an effective wavelength corresponding to ¼ of the wavelength of radio high-frequency signals received by and transmitted from the antenna 140. Further, the longitudinal direction of the metal plate 150 is set parallel to the main polarization direction of the antenna 140.

An antenna power supply pin 144 and connection pin 161 are attached to the second antenna holder 143. The antenna power supply pin 144 is used to electrically connect the antenna power supply terminal (pad) 132 on the circuit board 130 to the antenna 140. The antenna power supply pin 144 has its proximal end connected to the antenna element 141 by capacitive coupling, and its distal end kept in direct electrical contact with the antenna power supply pad 132 of the circuit board 130. The antenna power supply pad 132 and antenna element 141 may be directly connected. This connection is realized, for example, by forming the first antenna holder 142 of a conductive material, and putting the proximal end of the antenna power supply pad 132 into direct contact with the periphery of the first antenna holder 142.

The connection pin 161 is used to electrically connect the ground pad 134 of the circuit board 130 to the metal plate 150. The connection pin 161 has its proximal end kept in contact with an end of the metal plate 150 via a connection terminal 162, and its distal end kept in electrical contact with the ground pad 134 of the circuit board 130.

In the connection pin 161, an elastic mechanism using an elastic member such as a coil spring is interposed between the proximal and distal ends. The elastic mechanism absorbs a dimensional difference (variation) if it exists between the ground pad 134 and antenna holder 143. As a result, the tip of the connection pin 161 can be kept in contact with the antenna power supply pad 132 and ground pad 134 with a constant pressure.

In the above structure, the ground pattern of the circuit board 130 is connected to the metal plate 150 via the ground pad 134, connection pin 161 and connection terminal 162. Accordingly, during communication, part of the radio high-frequency current flowing to the ground pattern of the circuit board 130 flows to the metal plate 150. As a result, the radio high-frequency current flowing to the ground pattern is reduced, and hence the degradation of the radiation characteristic of the antenna 140 is suppressed.

Moreover, the metal plate 150 is connected to the ground pattern close to the antenna power supply pad 132. In other words, the metal plate 150 is connected to the ground pattern at a position at which the current distribution formed on the $\lambda/2$ wavelength whip antenna element 141 assumes a maximum value. Accordingly, part of the high-frequency current flowing to the ground pattern of the circuit board 130 can be efficiently guided to the metal plate 150, thereby effectively suppressing the degradation of the radiation characteristic of the antenna 140.

Also, the metal plate 150 is attached to the rear case 110. Therefore, the metal plate 150 can be positioned as far from the head of a user as possible, and hence the influence of the body of the user upon the communication apparatus can be reduced. This being so, the radio high-frequency current can be efficiently guided from the ground pattern to the metal plate 150, thereby better suppressing the degradation of the radiation characteristic of the antenna 140.

Furthermore, the direction of the metal plate 150 is set parallel to the longitudinal direction of the element 141, i.e., the main polarization direction. Therefore, in the metal plate 150, there is no danger of occurrence of a so-called intersecting polarization component perpendicular to the main polarization direction of the antenna 140. This means that the metal plate 150 does not raise any problem.

In addition, the connection pin 161 is attached to the holder 143 of the antenna 140 such that it connects the ground pad 134 of the circuit board 130 to the metal plate 150 of the rear case 110. This structure supports the connection pin 161 in a mechanically stable manner, which enhances the reliability of the communication apparatus. On the other hand, if the connection pin 161 is directly secured to the ground pad 134 of the circuit board 130 or to the metal plate 150, it may easily be bent or deformed.

Other Embodiments

In each of the above-described embodiments, a metal strip is used as a conductor. However, the conductor may have another configuration or structure. FIGS. 11A-11D, 12A-12D, 13A, 13B and 14 show other examples of the conductor.

Figure 11A:
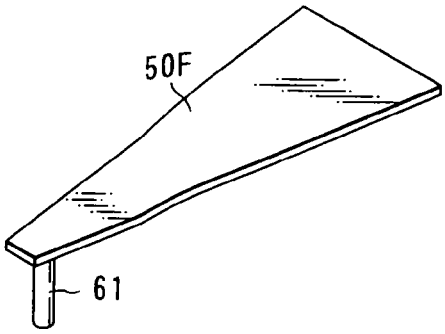
FIGS. 11A-11D are perspective views illustrating conductors of other structures.
Figure 12A:
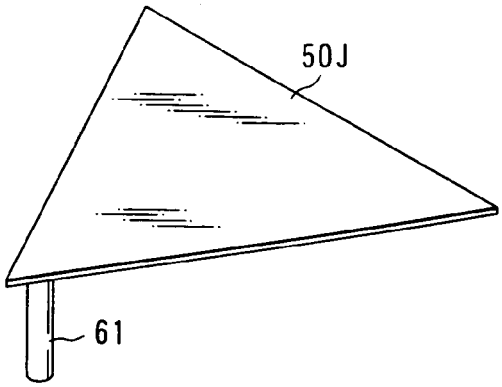
FIGS. 12A-12D are perspective views illustrating conductors of further structures.

In the cases shown in FIGS. 11A and 12A, connection pins 61 are attached to respective ends of a metal plate 5OF in the form of an isosceles triangle and a metal plate 50J in the form of a regular triangle.

Figure 11B:
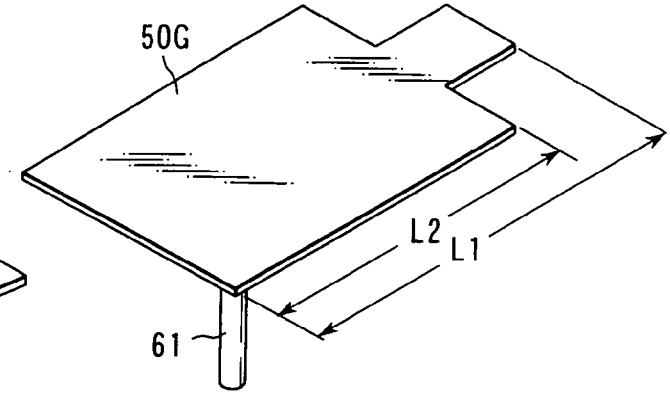
Figure 11C:
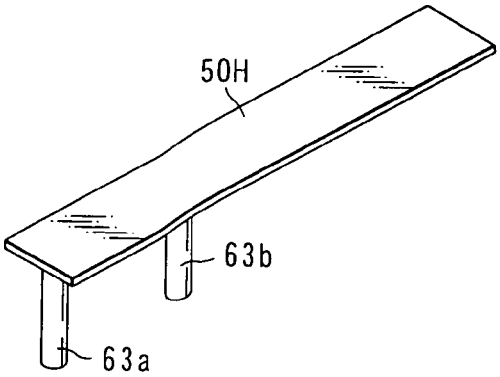
Figure 11D:
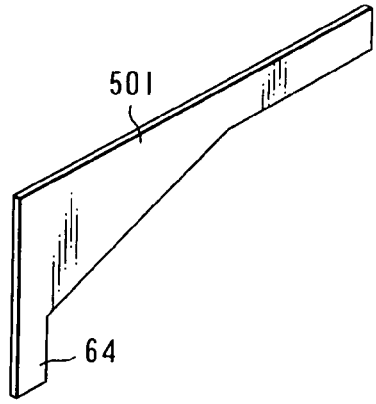
Figure 12B:
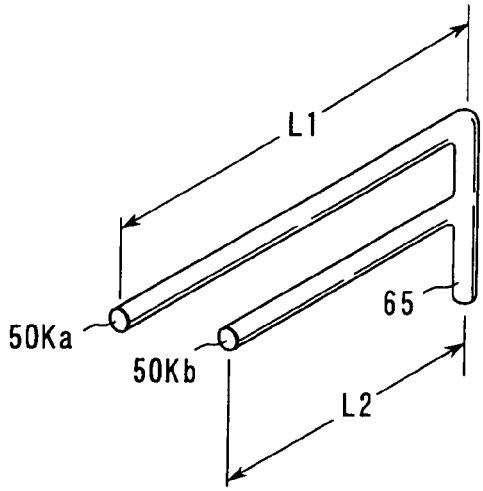
Figure 12C:
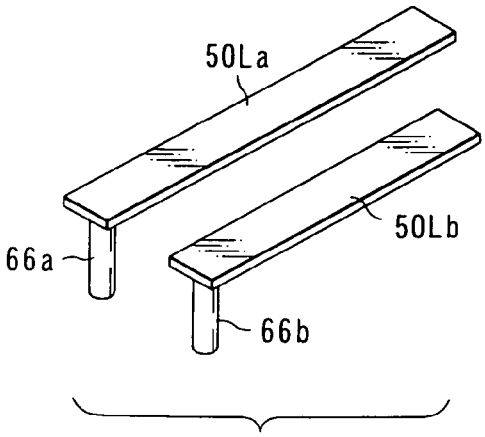
Figure 12D:
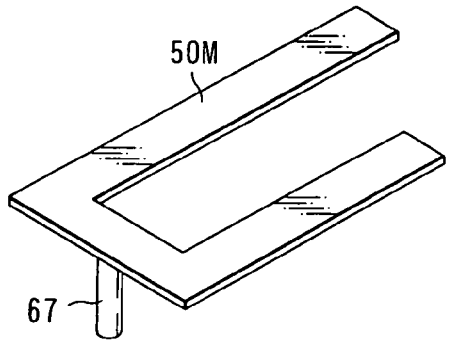

The metal plate 50G shown in FIG. 11B has a projection at one side thereof. This projection enables two effective wavelengths L1 and L2 to be set in a single metal plate. Two effective wavelengths can be realized even by the metal strip 50H shown in FIG. 11C, or the metal plate 50I shown in FIG. 11D. In the case of the metal strip 50H, connection pins 63*a* and 63*b* are provided at two different locations. In the case of the metal plate 50I, it has two sides of different lengths. Further, two effective wavelengths can be realized using two stick-shaped elements 50K*a* and 50K*b* of different lengths as shown in FIG. 12B, or using two metal plates 50L*a* and 50L*b* of different lengths with respective connection pins 66*a* and 66*b* as shown in FIG. 12C, or using a U-shaped plate 50M having sides of different lengths as shown in FIG. 12D.

The above-mentioned structures enable the current flowing to the ground pattern to be efficiently bypassed in units of frequency bands, when a single mobile communication apparatus is used for a plurality of systems that utilize different frequency bands.

Figure 13A:
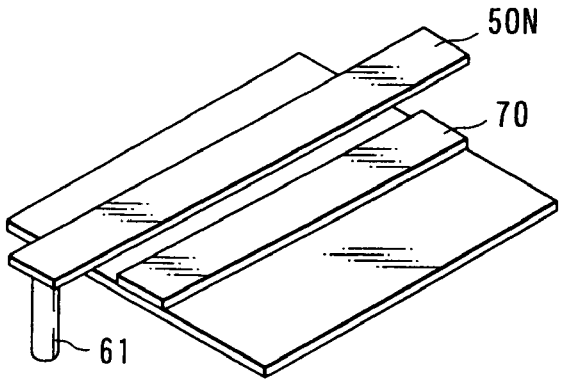
FIGS. 13A and 13B are perspective views illustrating conductors of other structures.
Figure 13B:
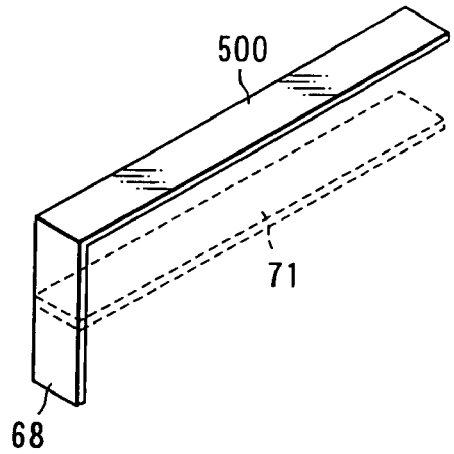

Further, as shown in FIG. 13A, an additional element 70 may be provided for a metal plate 5ON with a predetermined space therebetween. FIG. 13B shows another additional element. In this case, an additional element 71 is provided which realizes capacitive coupling with a metal plate 500.

Figure 14:
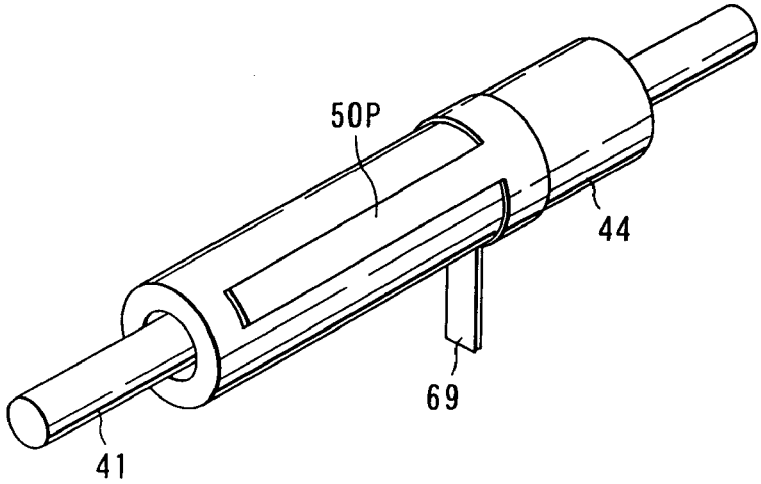
FIG. 14 is a perspective view illustrating a conductor of yet another structure.

Moreover, the conductor as shown in FIG. 14 may be used, which is obtained by forming, for example, a T-shaped conductive pattern 50P on the outer peripheral surface of an antenna tube 44 by deposition or plating, and attaching a connection chip 69 to an end of the conductive pattern 50P.

Although each of the above-described embodiments uses a metal plate as a conductor, the conductor may be in the form of a wire, stick or mesh. Furthermore, the material of the conductor is not limited to a metal, but may be an alloy, ceramic or polymer, etc. It is sufficient if the material has a high conductivity. If a ceramic or polymer is used, an increase in the weight of the resultant communication apparatus can be suppressed.

Figure 15A:
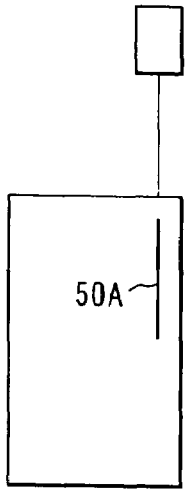
FIGS. 15A-15J are schematic views illustrating radio modules according to other embodiments of the invention.
Figure 15B:
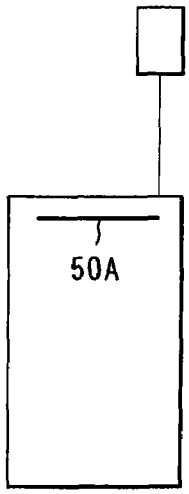
Figure 15C:
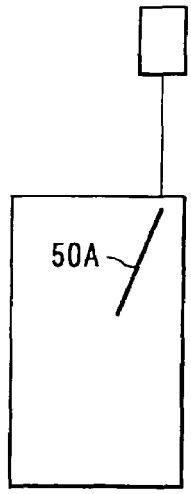
Figure 15D:
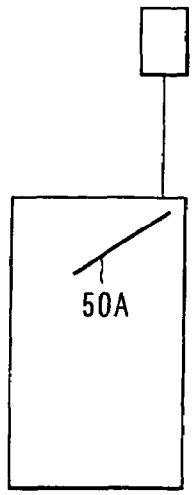
Figure 15E:
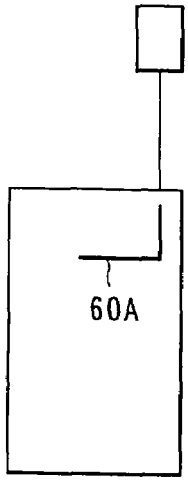
Figure 15F:
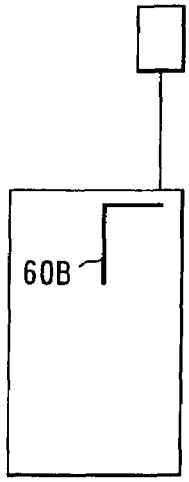
Figure 15G:
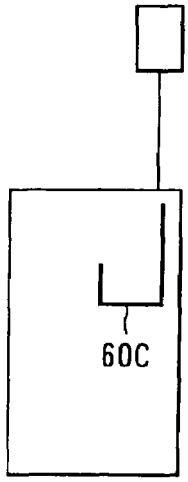
Figure 15H:
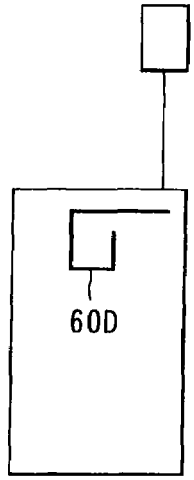
Figure 15I:
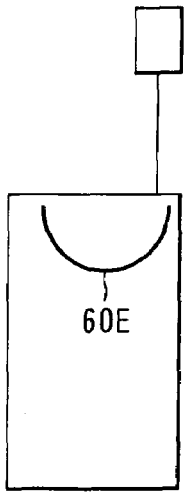
Figure 15J:
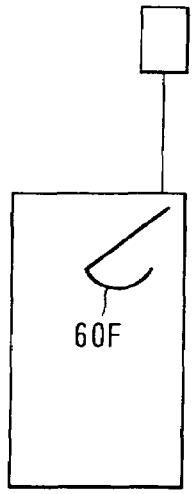
Figure 16A:
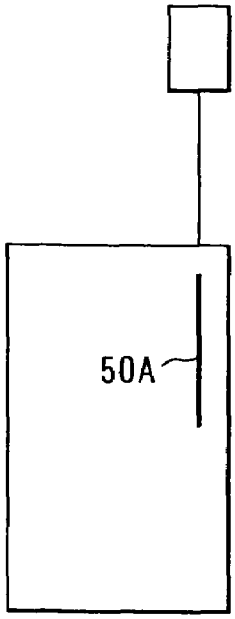
FIGS. 16A-16F are schematic views illustrating radio modules according to further embodiments of the invention.
Figure 16B:
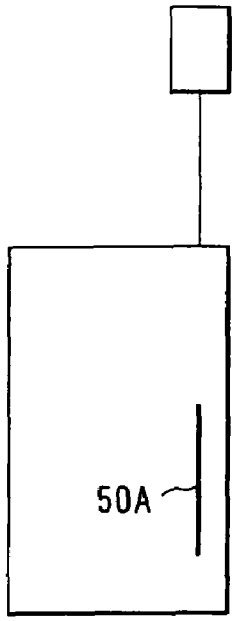
Figure 16C:
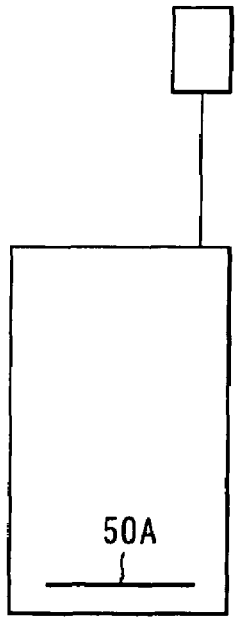
Figure 16D:
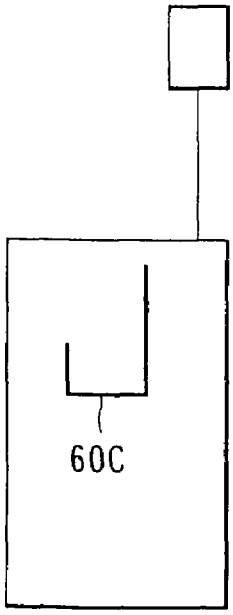
Figure 16E:
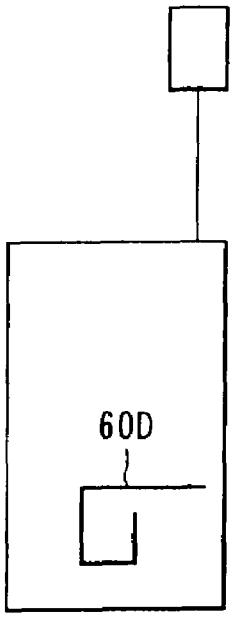
Figure 16F:
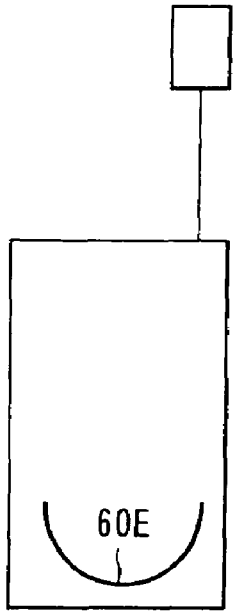

To suppress the occurrence of an intersecting polarization component, the direction of the conductor should be set parallel to the main polarization direction of the antenna as shown in FIG. 15A. However, in a case where the intersecting polarization component can be ignored, the direction of the conductor may be set in a direction different from the main polarization direction of the antenna, as is shown in FIGS. 15B-15D. Also, the level configuration of the conductor is not limited to an I-shape. The conductor may have an L-shape 60A, reversed L-shape 60B, U-shape 60C, numeral "6" shape 60D, arcuate shape 60E, or hook shape 60F, etc.

In addition, in the first to third embodiments, since a $\lambda/2$ wavelength antenna is used, the connection position of an end of the conductor on the ground pattern of the circuit board is set close to the antenna power supply point. However, depending upon the standards of antennas, the current distribution may assume a maximum value at a position other than the antenna power supply point and its vicinity. In light of this, it is advisable to appropriately set the connection position of the end of the conductor on the ground pattern in accordance with the standard of each antenna. FIGS. 16B-16F show position examples of the conductors 50A, 60C, 60D and 60E.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A radio module connecting a radio circuit to an antenna via a signal line, comprising:

a circuit board supporting the radio circuit, the circuit board comprising a ground pattern, a first surface, that faces a human body, and a second surface opposite to the first surface; and a passive conductor provided on the second surface, the conductor bypassing part of a current flowing on the ground pattern from the antenna when the antenna is used, the conductor having a proximal end and a distal end, the proximal end being directly connected to the ground pattern and positioned within ¼of a wavelength of the radio frequency signal of a power supply point of the antenna at which distribution of the current assumes a maximum value, and the distal end being open.

2. The radio module according to claim 1, wherein the proximal end of the conductor is connected to the ground pattern, provided on the second surface of the circuit board, at or close to a position at which distribution of the current assumes a maximum value.

3. The radio module according to claim 1, wherein if the antenna has an antenna element having a length equal to half a wavelength of a radio frequency signal, the proximal end of the conductor is connected to the ground pattern, provided on the second surface of the circuit board, close to an antenna power supply terminal of the signal line.

4. The radio module according to claim 1, wherein the conductor is located such that a longitudinal direction of the conductor is parallel to a main polarization direction of the antenna.

5. The radio module according to claim 1, wherein if the antenna receives or transmits radio frequency signals of different bands, the conductor includes a conductive plate having a plurality of edges, the edges having effective wavelengths corresponding to the respective bands.

6. The radio module according to claim 1, wherein if the antenna receives or transmits radio frequency signals of different bands, the conductor includes a plurality of conductive elements having effective wavelengths corresponding to the respective bands.

7. The radio module according to claim 1, wherein if the radio circuit is covered with a shield cap, the conductor is provided on the shield cap.

8. The radio module according to claim 1, wherein if the radio circuit is covered with a shield cap, the conductor is provided above the shield cap with spacers of a predetermined height interposed therebetween.

9. The radio module according to claim 1, wherein the conductor is formed of a conductive member bent in the form of a bracket, and the proximal end of the conductive member is connected to the ground pattern provided on the second surface of the circuit board.

10. The radio module according to claim 1, wherein the conductor is located such that a longitudinal direction of the conductor is orthogonal to a main polarization direction of the antenna.

11. A radio communication apparatus comprising:

an apparatus housing;

an antenna attached to the apparatus housing via a holder;

a circuit board supporting a radio circuit housed in the apparatus housing, the circuit board being provided with a signal line which connects the antenna to the radio circuit, the circuit board further comprising a ground pattern, a first surface, and a second surface that faces a human body, the second surface being opposite to the first surface; and a passive conductor provided on the second surface, the conductor bypassing part of a current flowing on the ground pattern from the antenna when the antenna is used, the conductor having a proximal end and a distal end, the proximal end being directly connected to the ground pattern and positioned within ¼of a wavelength of the radio frequency signal of a power supply point of the antenna at which distribution of the current assumes a maximum value, and the distal end being open.

12. The radio communication apparatus according to claim 11, wherein the proximal end of the conductor is connected to the ground pattern, provided on the second surface of the circuit board, at or close to a position at which distribution of the current assumes a maximum value.

13. The radio communication apparatus according to claim 11, wherein the conductor is formed of a conductive member bent in the form of a bracket, the distal end of the conductive member being secured to the apparatus housing, and the proximal end being kept in electrical contact with the ground pattern provided on the second surface of the circuit board.

14. The radio communication apparatus according to claim 11, wherein the conductor is formed of a conductive member secured to the apparatus housing, and a connection terminal secured to the proximal end of the conductive member, the connection terminal being in electrical contact with the ground pattern provided on the second surface of the circuit board when the circuit board is housed in the apparatus housing.

15. The radio communication apparatus according to claim 11, wherein the conductor is formed of a conductive member secured to the apparatus housing, and a connection terminal secured to the ground pattern on the second surface of the circuit board, the connection terminal being in electrical contact with the proximal end of the conductive member when the circuit board is housed in the apparatus housing.

16. The radio communication apparatus according to claim 15, wherein the connection terminal includes an elastic mechanism which expands and contracts between the conductive member and the ground pattern on the second surface of the circuit board.

17. The radio communication apparatus according to claim 11, wherein the conductor is formed of a conductive member secured to the apparatus housing, and a connection terminal secured to the holder of the antenna, the connection terminal having opposite ends brought into electrical contact with the proximal end of the conductive member and the ground pattern provided on the second surface of the circuit board.

18. The radio communication apparatus according to claim 11, wherein the conductor includes a conductive pattern formed on a peripheral surface of the holder of the antenna, and a connection terminal which electrically connects the conductive pattern to the ground pattern on the second surface of the circuit board.

* * * * *

UNITED STATES PATENT AND TRADEMARK OFFICE

CERTIFICATE OF CORRECTION

PATENT NO. : 7,456,795 B2
APPLICATION NO. : 11/819634
DATED : November 25, 2008
INVENTOR(S) : Chiba et al.

It is certified that error appears in the above-identified patent and that said Letters Patent is hereby corrected as shown below:

Claim 1, column 10, line 15, change “surface, that” to --surface that--.

Claim 1, column 10, line 23, change “1/4of” to --1/4 of--.

Claim 11, column 11, line 16, change “1/4of” to --1/4 of--.

Signed and Sealed this

Seventeenth Day of February, 2009

John Doll

JOHN DOLL
*Acting Director of the United States Patent and Trademark Office*